US005205432A

United States Patent [19]

Gullan

[11] Patent Number: 5,205,432

[45] Date of Patent: Apr. 27, 1993

[54] PACKAGING

[75] Inventor: Bryan B. Gullan, Douglas, Isle of Man

[73] Assignee: Manx Ices Limited, Douglas, Isle of Man

[21] Appl. No.: 777,332

[22] PCT Filed: May 25, 1990

[86] PCT No.: PCT/GB90/00820

§ 371 Date: Nov. 22, 1991

§ 102(e) Date: Nov. 22, 1991

[87] PCT Pub. No.: WO90/14296

PCT Pub. Date: Nov. 29, 1990

[30] Foreign Application Priority Data

May 26, 1989 [GB] United Kingdom ..... 8912170

[51] Int. Cl.[5] ..... B65D 23/08

[52] U.S. Cl. ..... 220/412; 206/545; 206/459.5

[58] Field of Search ..... 220/408, 410, 411, 412; 206/545, 459

[56] References Cited

U.S. PATENT DOCUMENTS

| | | |
|---|---|---|
| 2,591,578 | 4/1952 | McNealy . |
| 2,828,903 | 4/1958 | Adkins . |
| 3,314,531 | 4/1967 | Cheris . |
| 4,746,028 | 5/1988 | Bagg . |

FOREIGN PATENT DOCUMENTS

| | | |
|---|---|---|
| 0175231 | 5/1988 | European Pat. Off. . |
| 519759 | 4/1940 | United Kingdom . |
| 610559 | 10/1948 | United Kingdom . |
| 738282 | 10/1955 | United Kingdom . |
| 766082 | 1/1957 | United Kingdom . |
| 1201737 | 8/1970 | United Kingdom . |
| 1397877 | 6/1975 | United Kingdom . |
| 1403738 | 8/1975 | United Kingdom . |
| 1443847 | 7/1976 | United Kingdom . |
| 2057249 | 4/1981 | United Kingdom . |
| 2194514 | 3/1988 | United Kingdom . |

*Primary Examiner*—Joseph Man-Fu Moy

*Attorney, Agent, or Firm*—Peterson, Wicks, Nemer & Kamrath

[57] ABSTRACT

A packaging unit for a consumable product, comprises a tub-shaped container of a first material for containing the product, a casing of a second, thermally-insulating material for holding and rigidly supporting the container, and a closure of thermally-insulating material for the casing, the casing having an opening for allowing access to the contents of the container when the container is held in the casing, means for removable and replaceable engagement of the closure with the casing for alternately sealing off or freeing the access to the contents of the container, the container being insertable into the casing via the opening, and the casing and container being configured and arranged to preclude separating the container from the casing once the container has been received therein, the container and casing thus forming an integral unit.

10 Claims, 1 Drawing Sheet

PACKAGING

This invention relates to a packaging unit for a consumable product, in particular, though not exclusively, ice cream.

BACKGROUND TO THE INVENTION

One of the problems associated with transportation and display of ice cream for sale is in the provision of suitable packaging. It is known to provide a form of packaging for ice cream which includes a layer of thermally insulating material. It is an object of the present invention to provide a packaging unit which will at least provide a useful alternative to such known packaging.

BRIEF SUMMARY OF THE INVENTION

According to the invention there is provided a packaging unit for a consumable product, comprising a tub-shaped container of a first material for containing the product, a casing of a second, thermally-insulating material for holding and rigidly supporting the container, and a closure of thermally-insulating material for the casing, the casing having an opening therein for allowing access to the contents of the container when the container is held in the casing, there being means provided for removable and replaceable engagement of said closure with the casing for alternately sealing off or freeing said access to the contents of the container, the container being insertable into the casing via said opening, and the casing and container being configured and arranged to preclude separating the container from the casing once the container has been received therein, the container and casing thus forming an integral unit.

One of the advantages of such a packaging unit is that it is able to retain its integrity when the product is removed or served.

By way of example the preferred embodiment of the invention will now be described with reference to the accompanying drawings.

DESCRIPTION OF THE PREFERRED EMBODIMENT

Figure 1:
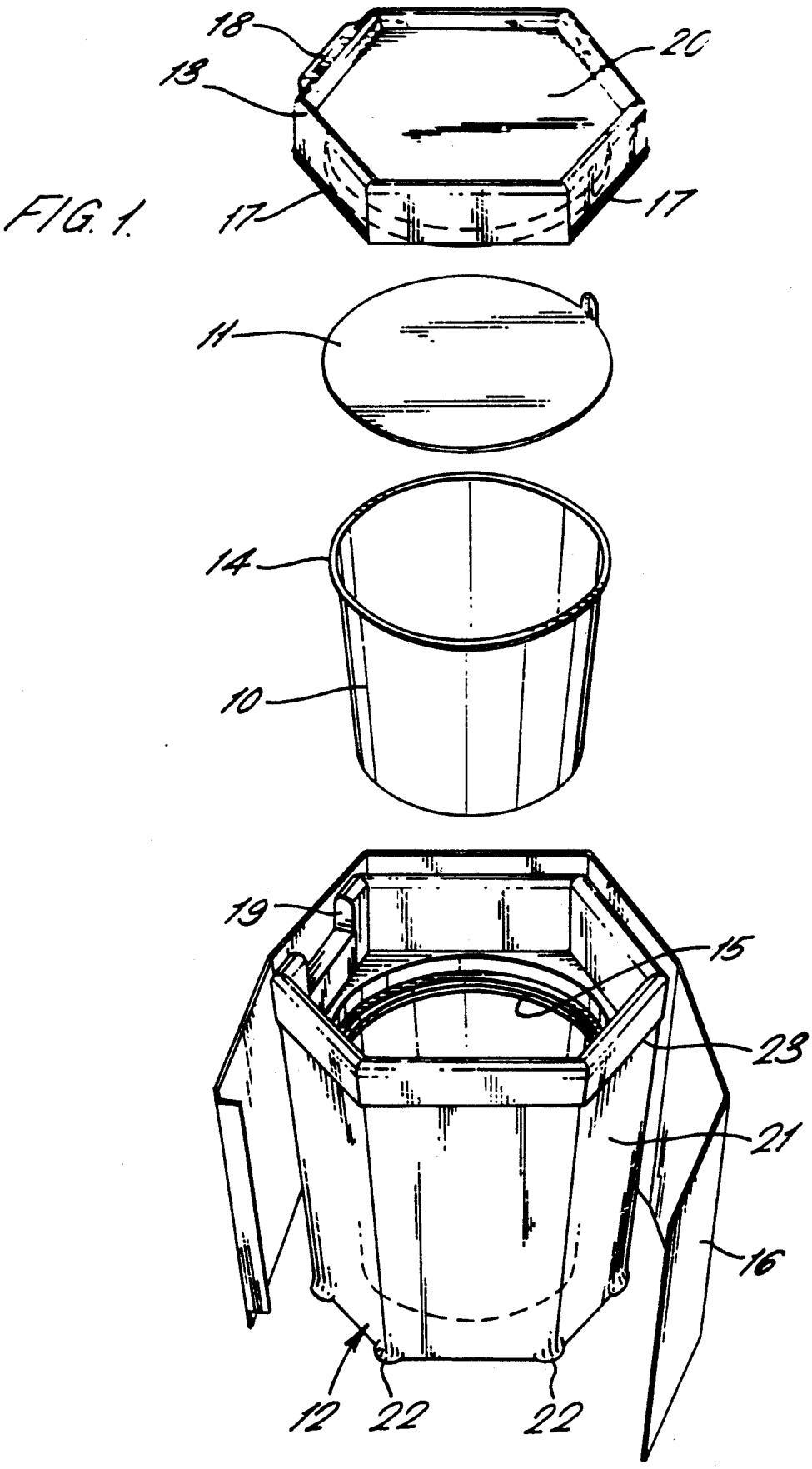
FIG. 1 is an exploded perspective view showing an embodiment of a packaging unit according to the invention.

There is seen in FIG. 1 a packaging unit for ice cream. The unit comprises a container 10 into which the ice cream is put. Container 10 is of standard form and is conveniently made from moulded plastics material. Container 10 has a lid 11. Lid 11 here is simply of cardboard and is disposable.

Casing 12 is made of thermally insulating material, conveniently, from molded expanded polystyrene. Casing 12 has a closure 13. Closure 13 here is also made from moulded expanded polystyrene and is replaceable. Closure 13 comprises ribs 17 so that it engages casing 12 with an interference fit.

Container 10 is received in casing 12 with means being provided for preventing the container from being separated from the casing. In this way, an integral packaging unit is provided.

In the embodiment shown, this means takes the form of an external lip 14 around container 10 and an internal groove 15 on casing 12. Container 10 can thus be engaged in casing 12 with a "snap-fit". It would of course be possible to provide a groove on the container and a lip on the casing instead.

Further alternative arrangements are of course possible. For example, casing 12 could be produced in two halves which can be fitted to either side of container 10 and then fastened together. Or, container 10 could be arranged to be a tight fit in casing 12 so that the two remain intact by frictional forces. This engagement may be strengthened by providing surface irregularities, e.g. ribs or pimples, on the interengaging surfaces of one or both of the container and casing. Additionally or alternatively, adhesive may be used to keep the two together.

The packaging unit described is able to retain its integrity when the ice cream is removed, for example, turning the unit upside down, or served. The advantage of this is that the unit is able to provide a useful and attractive closable packaging unit even after it has served its original purpose.

Casing 12 here is of hexagonal cross-section. This is advantageous for both display and transportation purposes since it enables the packaging units to be arrayed together in a honey-comb pattern.

Casing 12 here also has a downward taper, as can be seen in the drawings. This is advantageous when arraying numbers of packaging units together in a honeycomb pattern, because it means that each unit is effectively surrounded and separated from its neighbours by a pocket of air which is trapped, thereby improving insulation.

In the drawings, 16 represents a sleeve, e.g. of printed card, to finish off and carry decorative artwork for casing 12. Similar artwork may be carried by replaceable closure 13.

In FIG. 1, reference 18 is a tab on the closure 13 which is shaped and arranged to engage in a slot 19 in an upper wall of the casing 12. The closure 13 is a flush fit within the upper interior of the casing 12 so that the tab 18 is used in removing the closure 13. The presence of the tab 18 and slot 19 provides a convenient means of registration when applying appropriate artwork to both the casing 12 and closure 13.

The upper surface of the closure 13 may be recessed just enough to accept a sheet of art work, e.g. of printed card, so that the closure presents a substantially flat top surface on final assembly. In the alternative, the upper surface 20 can be more pronouncedly recessed and be dimensioned so as to accept within its recess the bottom of another like casing. In this way, one complete packaging unit can be placed upon another so that the two are located laterally relative to each other when stacked.

To facilitate application of the art work to the casing 12, sleeve 16 is designed to fit a recessed surface portion 21 of the casing. Sleeve 16 is assembled into a tubular form, e.g. by gluing a folded blank, and simply pushed over feet 22 which are provided at the bottom corners of the casing. The sleeve 16 is retained in position on the casing between the feet 22 and shoulder 23 formed by the recessed surface portion.

What is claimed is:

1. A packaging unit for a consumable product, comprising, in combination: a tub-shaped container of a first, thin-walled material for containing the product, a casing of a second, thick-walled thermally-insulating material, with the casing having an opening therein, with the container being insertable into the casing via said opening and received in, held by, and rigidly supported by the casing, with the dimensional relationships of the container in the casing forming a tight fit therebetween to prevent dissassembly of the container and the casing once the container has been received by the casing, with the opening of the casing allowing access to the contents of the container when the container is held in the casing, a closure of thick-walled thermally-insulating material for the casing, with the thick-walled thermally-insulating material of the casing and of the closure being substantially thicker than the thin-walled material of the container, means for removable and replaceable engagement of said closure with the casing for alternately sealing off or freeing said access to the contents of the container, and a sleeve located on the outer wall of the casing for finishing off and carrying decorative artwork for the casing.

2. A packaging unit as claimed in claim 1 wherein the container is received within the casing by a friction fit and separation is precluded by the frictional forces arising from said friction fit.

3. A packaging unit as claimed in claim 2 wherein at least one of the containers and casing comprise surface irregularities on their interengaging surfaces to enhance said frictional forces.

4. A packaging unit as claimed in claim 1 wherein the container has a radially outwardly protruding lip which engages the casing when the container is received therein.

5. A packaging unit as claimed in claim 1 wherein adhesive is used between the container and casing.

6. A packaging unit as claimed in claim 1 wherein the casing has a downward taper.

7. A packaging unit as claimed in claim 1 wherein the casing is of hexagonal section.

8. A packaging unit as claimed in claim 1 wherein the container is provided with a disposable lid.

9. A packaging unit as claimed in claim 1 wherein said first material is a moulded plastics material.

10. A packaging unit as claimed in claim 1 wherein said second material is moulded expanded polystyrene.

* * * * *